US010147346B2

(12) United States Patent
Ding et al.

(10) Patent No.: US 10,147,346 B2
(45) Date of Patent: Dec. 4, 2018

(54) GAMMA CALIBRATION METHOD FOR THREE PRIMARY COLORS

(71) Applicants: Weikang Ding, Shanghai (CN); Zhanmin Xia, Shanghai (CN)

(72) Inventors: Weikang Ding, Shanghai (CN); Zhanmin Xia, Shanghai (CN)

( * ) Notice: Subject to any disclaimer, the term of this patent is extended or adjusted under 35 U.S.C. 154(b) by 105 days.

(21) Appl. No.: 15/182,604

(22) Filed: Jun. 15, 2016

(65) Prior Publication Data

US 2016/0293088 A1 Oct. 6, 2016

Related U.S. Application Data

(63) Continuation of application No. PCT/CN2014/090296, filed on Nov. 5, 2014.

(30) Foreign Application Priority Data

Dec. 18, 2013 (CN) ..... 2013 1 0695236

(51) Int. Cl.
*G09G 3/20* (2006.01)
*G09G 5/06* (2006.01)

(52) U.S. Cl.
CPC ..... *G09G 3/2003* (2013.01); *G09G 5/06* (2013.01); *G09G 2300/026* (2013.01); *G09G 2320/0233* (2013.01); *G09G 2320/0242* (2013.01); *G09G 2320/0673* (2013.01); *G09G 2320/0693* (2013.01)

(58) Field of Classification Search
CPC ..... G09G 2300/026; G09G 2320/0233; G09G 2320/0242
See application file for complete search history.

(56) References Cited

U.S. PATENT DOCUMENTS

2006/0055835 A1 3/2006 Nitta et al.
2007/0159448 A1 7/2007 Inuzuka et al.
2009/0278982 A1* 11/2009 Imai ..... G09G 5/02 348/453
2011/0279749 A1 11/2011 Erinjippurath et al.
2012/0038688 A1* 2/2012 Deyama ..... G09G 5/02 345/690

FOREIGN PATENT DOCUMENTS

JP 5123773 B2 1/2013

* cited by examiner

*Primary Examiner* — Chun-Nan Lin

(74) *Attorney, Agent, or Firm* — Wayne & Ken, LLC; Tony Hom

(57) ABSTRACT

A gamma calibration method based on three primary colors is disclosed. The method comprises following steps: performing the gamma calibration onto one of two electro-optic display systems which have three primary colors with different intrinsic wavelengths; correcting the three primary colors of the two electro-optic display system and an output dominant wavelength of a first system of the two electro-optic display systems, resulting in a transition from the output dominant wavelength of the first system to a output dominant wavelength of a second system of the two electro-optic display system, so that the output dominant wavelength of the first system being more and more consistent with the output dominant wavelength of the second system in color space.

4 Claims, 7 Drawing Sheets

GAMMA CALIBRATION METHOD FOR THREE PRIMARY COLORS

CROSS-REFERENCE TO RELATED APPLICATIONS

This application is a continuation of International Patent Application No, PCT/CN2014/090296 with an international filing date of Nov. 5, 2014 designating the United States, and further claims priority benefits to Chinese Patent Application No. 201310695236.7 filed Dec. 18, 2013. The content of the aforementioned applications, including any intervening amendments thereto, is incorporated herein by reference.

TECHNICAL FIELD

The present invention relates to a method for three-primary-color calibration for a display device, and particularly relates to three-primary-color combined gamma calibration.

BACKGROUND

At present, electro-optic conversion characteristics of almost all display devices are nonlinear. One device which is not subjected to gamma calibration will affect the brightness of a final output image (video). For example, one color is composed of 50% of red and 80%, of green, and through a display which is not subjected to gamma calibration (for example, in FIG. 1, $\gamma=2.2$), the brightness of an output result is 21.8% of red and 61.2% of green respectively, and the brightness is greatly reduced.

A usual method is that an adverse-effect gamma compensation curve is used for calibration, and a gamma curve function with a power which is $\gamma=1/2.2=0.45$, is set for calibration: output=(input)$^{0.45}$, as shown in FIG. 2, so as to restore an original image (video) file.

The essence of gamma calibration is nonlinear transformation. The gamma calibration is characterized in that on the basis of intrinsic wavelengths of three primary colors RGB, electro-optic nonlinear transformation is carried out on R, G and B respectively, so as to restore an original image (video) file, and the way is single-primary-color (one-dimensional)-based nonlinear transformation-(single-primary-color/one-dimensional) gamma calibration, as shown in FIG. 3.

Usually, single-color nonlinear transformation will be brought in each link of obtaining an image (video), storing an image (video) file, reading the image (video) file, and displaying the image (video) file on a display.

However, if one image (video) file needs to be restored through integrated display of two electro-optic display systems with different intrinsic wavelengths, and display effects of the two systems after restoration are required to be consistent, and it is quite difficult for the single-color gamma calibration to meet the requirement, as shown in FIG. 4.

An electro-optic system$_1$ differs from n electro-optic system$_2$ in the different intrinsic wavelengths of three primary colors RGB, that is:

wavelength $R_1 \neq$ wavelength $R_2$ wavelength $G_1 \neq$ wavelength $G_2$ wavelength $B_1 \neq$ wavelength $B_2$ With regard to input of one and the same image (video) file, the electro-optic system$_1$ and the electro-optic system$_2$ are not enabled to restore the input image (video) file to images (videos) with the same display effects no matter how the actually universal single-primary-color-based gamma calibration sets the two gamma functions $\gamma_1$ and $\gamma_2$.

A general method is that a group of three-primary-color substances is chosen, and the intrinsic wavelengths of the RGB of these substances are capable of better restoring an original image (video), for forming electro-optic display systems. However, when the choice needs the response of a whole industrial chain, or has no support of such an industrial chain; or the intrinsic wavelengths of the three primary colors RGB of the two systems are all suitable for restoring the original image (video), but these two systems are still different, that is to say: when two electro-optic display systems with intrinsic wavelengths which are not completely the same have to be used and combined for displaying and forming the same image (video) to be output, the single-primary-color (one-dimensional)-based gamma calibration is helpless.

SUMMARY

The objective of the present invention is a three-primary-color (three-dimensional)-based combined gamma calibration method, for overcoming problems existing in the prior art with regard to three-primary-color calibration. The present invention designs three-primary-color combined gamma calibration which is characterized by not only the electro-optic nonlinearity is calibrated but also the output dominant wavelengths of the system is calibrated being applied to two electro-optic display systems with three primary colors having intrinsic wavelengths which are not completely the same or to a single electro-optic display system. Thus, effective migrations occur to output dominant wavelengths of three primary colors of the systems with respect to intrinsic wavelengths (or dominant wavelength) of the original three primary colors, so that output dominant wavelengths$_{1\ and\ 2}$ of two groups of three primary colors (RGB)$_{1\ and\ 2}$ with intrinsic wavelengths which are not completely the same of two systems trend to be consistent in the whole color gamut space, or so that the output dominant wavelengths of a single system meets the calibration requirements in the whole color gamut space. The three-primary-color combined gamma calibration is characterized in that: with regard to the two electro-optic display systems with three primary colors having intrinsic wavelengths which are not completely the same, or with regard to the single electro-optic display system, outputs of the systems under the same source image (video) file are calibrated through the three-primary-color combined gamma calibration which actively brings in and superposes other primary color components. The three-primary-color combined gamma calibration is characterized in that: with regard to the two electro-optic display systems three primary colors having intrinsic wavelengths which are not completely the same, electro-optic and output dominant wavelength calibrations are carried out by virtue of the three-primary-color combined gamma calibration in the whole color gamut space.

The present invention has the following advantages: the three-primary-color combined gamma calibration is applied to two three-primary-color electro-optic nonlinear display systems with different intrinsic wavelengths (or to a single electro-optic nonlinear display system) in the way that not only the electro-optic nonlinearity is calibrated but also a dominant wavelengths of each of these two systems (or the single system) in a whole color gamut space composed of RGB is calibrated by way of actively bringing in and superposing other primary color components. Thus, effective migrations occur to the dominant wavelength outputs by the systems, so that output dominant wavelengths$_{1\ and\ 2}$ of two groups of three primary colors $(RGB)_{1\ and\ 2}$ with intrinsic wavelengths which are not completely the same of two systems trend to be consistent in the whole color gamut space, or so that the output dominant wavelengths of the single system much approximates to a real world in the whole color gamut space. Through the three-primary-color combined gamma calibration, continuous calibration can be carried out by virtue of a γ gamma function, and even point-by-point calibration can also be carried out in the whole color gamut space, thus approximation and restoration of an output color space for the real world are furthest met.

DESCRIPTION OF THE DRAWINGS

In FIG. 1, γ=2.2 in gamma calibration, the brightness of an output result is 21.8% of red and 61.2 of green respectively, and the brightness is greatly reduced. In FIG. 1, the longitudinal coordinate is percentage of brightness (%), and the transversal coordinate is percentage of input voltage (%).

In FIG. 6, the intrinsic wavelength of green primary color of an LED is $G_{LED}$=530; and the intrinsic wavelength of green primary color of an LCD is $G_{LCD}$=545.

In FIG. 7, the intrinsic wavelength of green primary color of an LED is $G_{LED}$=530; the intrinsic wavelength of green primary color of an LCD is $G_{LCD}$=545; and the intrinsic wavelength of red primary color of an LED is $R_{LED}$=625.

DETAILED DESCRIPTION

Figure 1:
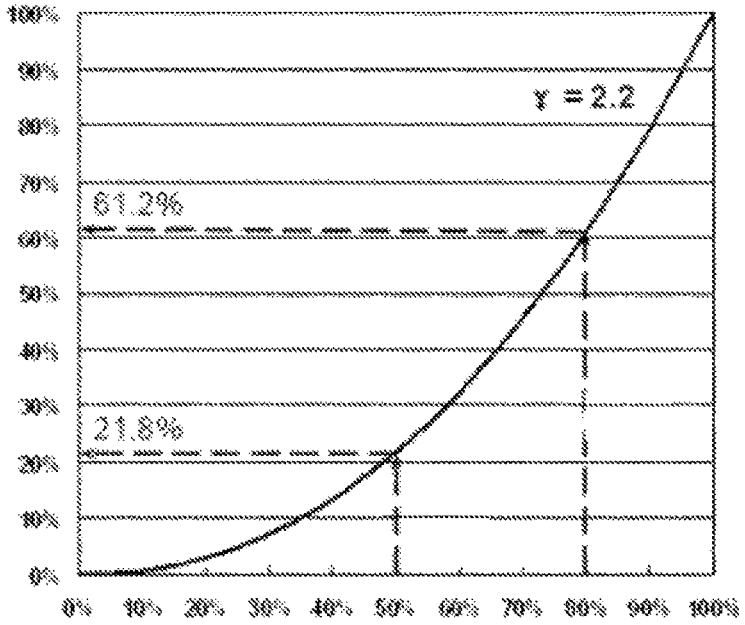
FIG. 1 shows output characteristics of display which is not subjected to gamma calibration.
Figure 2:
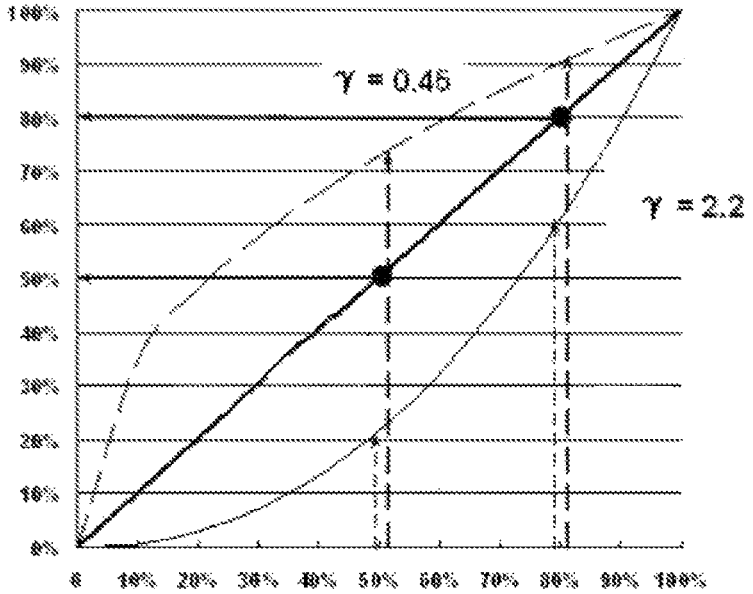
FIG. 2 shows a gamma function curve with a power which is γ=1/2.2=0.45. Output=(input)$^{0.45}$, γ=0.45 in gamma calibration, and γ=2.2 before gamma calibration, in FIG. 2, the longitudinal coordinate is percentage of brightness (%), and the transversal coordinate is percentage of input voltage (%).
Figure 3:
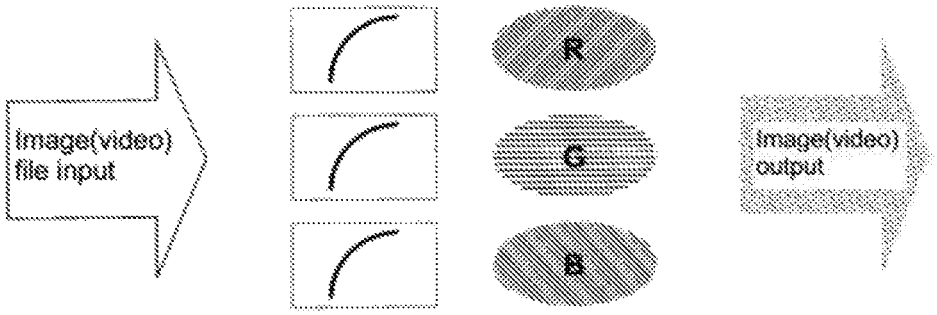
FIG. 3 is a schematic diagram of single-primary-color (one-dimensional)-based nonlinear transformation—that is, (single-primary-color/one-dimensional) gamma calibration.
Figure 4:
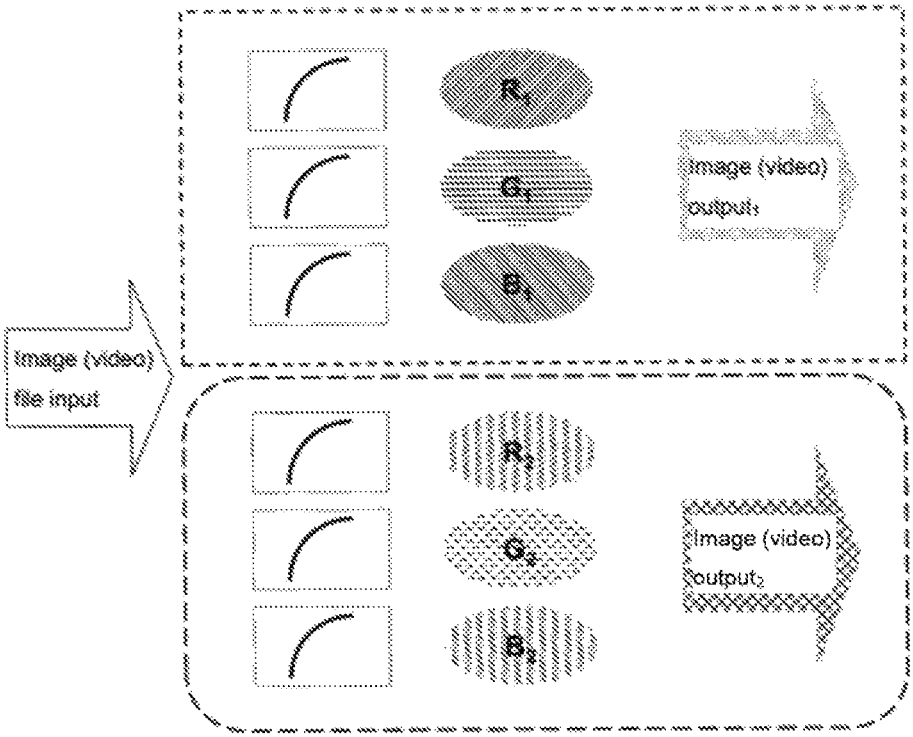
FIG. 4 is a schematic diagram when restoration is carried out through single-primary-color gamma calibrations respectively with regard to combined/integrated display of two electro-optic display systems with different intrinsic wavelengths.
Figure 5:
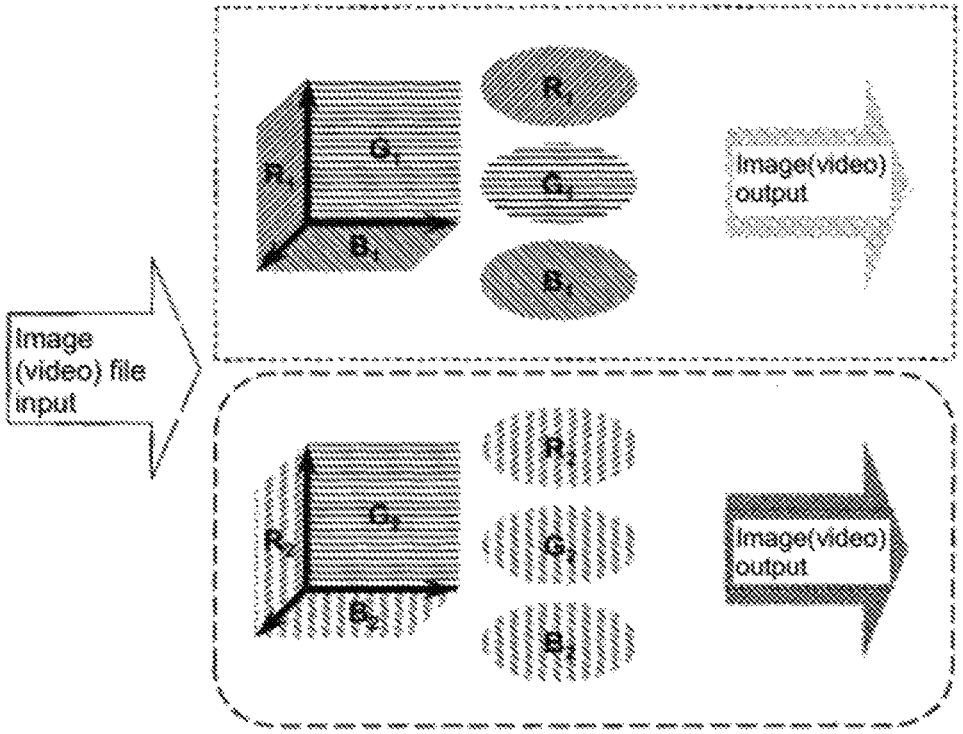
FIG. 5 is a schematic diagram of three-primary-color (three-dimensional) combined gamma calibration of the present invention.

Three-primary-color combined gamma calibration is characterized by not only the electro-optic nonlinearity is calibrated but also the output dominant wavelengths of the system is calibrated being applied to two electro-optic display systems with three primary colors having intrinsic wavelengths which are not completely the same or to a single electro-optic display system. Thus, effective migrations occur to output dominant wavelengths of three primary colors of the systems with respect to intrinsic wavelengths (or dominant wavelength) of the original three primary colors, so that output dominant wavelengths$_{1\ and\ 2}$ of two groups of three primary colors $(RGB)_{1\ and\ 2}$ with intrinsic wavelengths which are not completely the same of two systems trend to be consistent in the whole color gamut space, or so that the output dominant wavelengths of a single system meets the calibration requirements in the whole color gamut space. The three-primary-color combined gamma calibration is characterized in that: with regard to the two electro-optic display systems with three primary colors having intrinsic wavelengths which are not completely the same, or with regard to the single electro-optic display system, output of the system under the same source image (video) file is calibrated through the three-primary-color combined gamma calibration which actively brings in and superposes other primary color components. The three-primary-color combined gamma calibration is characterized in that: with regard to the two electro-optic display systems with three primary colors having intrinsic wavelengths which are not completely the same, electro-optic and output dominant wavelength calibrations are carried out by virtue of the three-primary-color combined gamma calibration in the whole color gamut space.

The present invention is characterized in that (mathematics):

three-primary-color (three-dimensional) combined gamma calibration:

$$R_{out}=f(R_{in},G_{in},B_{in})$$

$$G_{out}=g(R_{in},G_{in},B_{in})$$

$$B_{out}=h(R_{in},G_{in},B_{in})$$

$$\alpha=(R_{out},G_{out},B_{out}f(R_{in},G_{in},B_{in}),g(R_{in},G_{in},B_{in}))$$

$$(R_{out},G_{out},B_{out})=(f(R_{in},G_{in},B_{in}),g(R_{in},G_{in},B_{in}))$$

Note: single-primary-color (one-dimensional) gamma calibration:

$$R_{out}=f(R_{in})$$

$$G_{out}=g(G_{in})$$

$$B_{out}=h(B_{in})$$

Or $$\alpha_R=(R_{out}f(R_{in})$$

$$\alpha_G=(G_{out},g(G_{in})$$

$$\alpha_B=(B_{out},h(B_{in})$$

$$(R_{out},G_{out},B_{out})=(f(R_{in}),g(G_{in}),h(B_{in}))$$

The three-primary-color (three-dimensional)-based combined gamma calibration is characterized in that not only electro-optic conversion is subjected to nonlinear transformation but also the output dominant wavelengths$_1$ or/and the output dominant wavelengths$_2$ of intrinsic wavelengths $(RGB)_1$ and $(RGB)_2$ are subjected to nonlinear compensation calibration.

When the electro-optic system; and the electro-optic system$_2$ cannot use three primary colors with intrinsic wavelengths which are completely the same due to various limits, outputs of the two systems are enabled to achieve great approximation through the three-primary-color (three-dimensional) combined gamma calibration. The three-primary-color (three-dimensional) combined gamma calibration may be applied to one system only, or to two systems according to the actual conditions.

The way of displaying the same image (video) file by virtue of two electro-optic systems with different intrinsic wavelengths can be applied to a device for eliminating splicing borders of display screens.

LCD screens (or PDP display screens) in the real world are all provided with (black) borders and the borders cannot be completely removed no matter how small the borders are, due to limits of an industrial chain and physical limits. When the liquid crystal display screens with the borders are arrayed and then spliced into a display system with larger dimensions, the borders become partitions without images (videos), so that the spliced liquid crystal display screens cannot completely display original images (videos).

If a border display system of an LED (or OLED, LE and even another LCD and the like) is embedded on a surrounding borders of a display screen through a certain means, thus display of the LED and the like on the borders become a portion of the whole image (video) of an LCD screen (or a PDP display screen), and then an image (video) consistent with a source image (video) file is formed, and the arrayed LCD screens become a 'seamless' display system.

In this way, the case is generated that the same image (video) file is restored by two groups of electro-optic display systems with different intrinsic wavelengths:

the electro-optic display $system_1$=the LCD screen (or the PDP display screen)

the electro-optic display $system_2$=the LED (or OLED, LE and even another LCD and the like). Obviously, the intrinsic wavelengths of the three primary colors $(RGB)_{LCD\ or\ PDP}$ of the LCD screen (or the PDP display screen) and the intrinsic wavelengths of the three primary colors $(RGB)_{LED\ and\ the\ like}$ of the LED and the like are not completely the same, that is, the intrinsic wavelengths (R, G and B)$_{LCD\ or\ PDP}$≠the intrinsic wavelengths (R, G and B)$_{LED\ and\ the\ like}$.

Therefore, display of the LCD screen (or the POP display screen) and display of the LED and the like on the borders cannot be mutually approximated or fused through the single-primary-color-based gamma calibration, and a 'seamless' effect will be affected.

Figure 6:
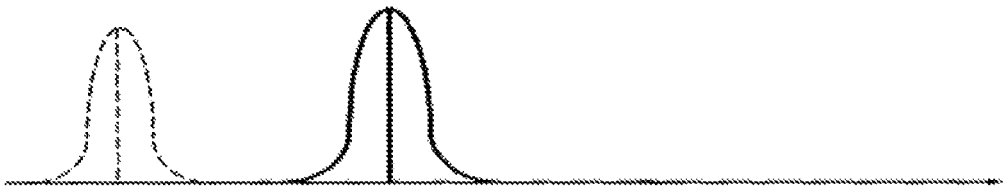
FIG. 6 is a wavelength schematic diagram when output dominant wavelengths of two systems are subjected to nonlinear calibration while electro-optic nonlinear calibration is carried out by adopting the three-primary-color (three-dimensional) combined gamma calibration, of the present, invention.
Figure 7:
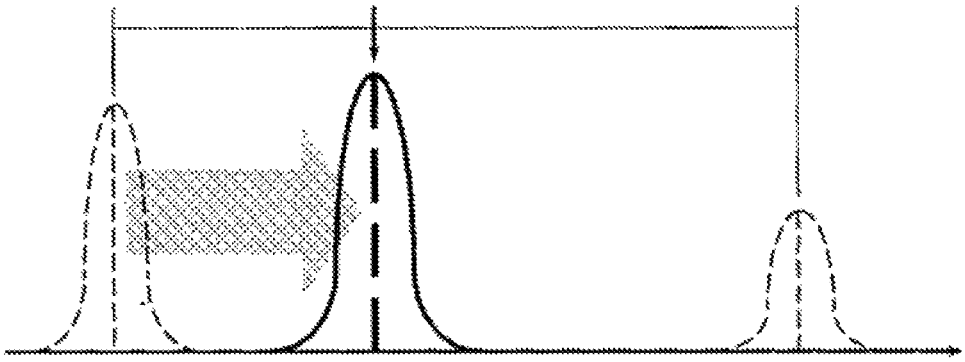
FIG. 7 is a difference schematic diagram of intrinsic wavelengths of green primary colors of two electro-optic display systems with the different intrinsic wavelengths when the three-primary-color (three-dimensional) combined gamma calibration is adopted, of the present invention.

Output dominant wavelengths of two systems are subjected to nonlinear calibration while electro-optic nonlinear calibration is carried out by utilizing the principles of 'additive color mixture' and 'metameric colors' (with the same hues and different spectral compositions), and by adopting the three-primary-color (three-dimensional) combined gamma calibration. Thus, migrations occur to the dominant wavelength (hue) output by each electro-optic display system with respect to intrinsic wavelengths (or dominant wavelength) of original three primary colors, so that output dominant $wavelength_1$ and output dominant $wavelength_2$ of two groups of three primary colors $(RGB)_1$ and $(RGB)_2$ with intrinsic wavelengths which are not completely the same trend to be consistent in the whole color gamut space. The basic process is shown in FIG. 6. A difference schematic diagram of intrinsic wavelengths of green primary colors of the two electro-optic display systems with different intrinsic wavelengths is shown in FIG. 7.

The dominant $wavelengths_{1\ and\ 2}$ of green primary colors of the two electro-optic display systems with different intrinsic wavelengths trend to be consistent. Through the three-primary-color (three-dimensional) combined gamma calibration, not only three primary colors are subjected to electro-optic nonlinear transformation calibration but also output dominant wavelengths of the systems are subjected to compensation calibration.

From another point of view, with regard to green primary color only, through the three-primary-color (three-dimensional) combined gamma calibration, not only (one-dimensional) electro-optic nonlinearity of the green primary color is calibrated but also a red component is actively brought in and superposed. Thus, migration occurs to the green dominant wavelength output by a system, and moreover, the value of the red component is varied while the change of green primary color in the whole color gamut. In this way, through the three-primary-color (three-dimensional) combined gamma calibration:

1) the electro-optic nonlinearity of the system is calibrated;
2) the output dominant wavelengths of the systems are also subjected to nonlinear calibration in the whole color gamut space;
3) this calibration with regard to the dominant wavelength is achieved by way of actively bringing in and superposing other primary color components;
4) the superposed components are the functions of the calibrated primary colors in the whole color gamut space.

The present invention can also be applied to an occasion with a single electro-optic display system; when one group of three primary colors RGB of the system is not sufficient to approximate to a real world, or, when the real world can be better approximated by three primary colors RGB with the original intrinsic wavelengths through nonlinear calibration for dominant wavelengths and the active migrations thereof, the three-primary-color (three-dimensional) combined gamma calibration becomes an effective means. The present invention is characterized in that (List):

| Characteristics | Three-primary-color (three-dimensional) gamma calibration | Single-primary-color (one-dimensional) gamma calibration |
|---|---|---|
| Calibration way | Three-primary-color combined calibration | Single-primary-color independent calibration |
| Number of systems | One system or more than one combined systems | One system |
| Calibration object 1) | Electro-optic nonlinear input-output | Electro-optic nonlinear input-output |
| Calibration object 2) | Dominant wavelength (in the whole color gamut space) | / |
| Calibration space | Three-dimensional (a three-dimensional space composed of RGB) | One-dimensional (three independent single primary colors) |
| Calibration process | Any primary color is related to other primary colors in the whole color gamut | Unrelated to other primary colors |
| Color composition | Not completely limited by the intrinsic wavelengths of three primary colors | Completely limited by the intrinsic wavelengths of three primary colors |
| Composition form | Actively bringing in and superposing other primary color components | / |
| Calibration quantity (supposing 8-bit grey level) | $16,777,216 = 256^3$ | $768 = 256 \times 3$ |
| Calibration method 1) | Carrying out continuous calibration by virtue of a γ gamma function | Carrying out continuous calibration by virtue of a γ gamma function |

-continued

| Characteristics | Three-primary-color (three-dimensional) gamma calibration | Single-primary-color (one-dimensional) gamma calibration |
|---|---|---|
| Calibration method 2) | Carrying out point-by-point calibration in the whole color gamut space | / |

We claim:

1. A gamma calibration method for three primary colors, comprising the following steps:

performing the gamma calibration onto one of two electro-optic display systems, wherein the three primary colors of the two electro-optic display systems are different in intrinsic wavelengths;

correcting the three primary colors of a first system of the two electro-optic display systems and an output dominant wavelength of the first system of the two electro-optic display systems, resulting in a transition from the output dominant wavelength of the first system to an output dominant wavelength of a second system of the two electro-optic display systems, so that the output dominant wavelength of the first system is consistent with the output dominant wavelength of the second system in color space.

2. The gamma calibration method for three primary colors according to claim 1, wherein the method further comprising the following steps:

introducing and superposing other primary color components in the gamma calibration to correct an output of the first system of the two electro-optic display systems with respect to an image video file, wherein said other primary color components are the primary colors other than the one that is being correct.

3. A gamma calibration method for three primary colors, comprising the following steps:

performing the gamma calibration onto two electro-optic display systems, wherein the three primary colors of the two electro-optic display systems are different in intrinsic wavelengths;

correcting the three primary colors of the two electro-optic display systems and output dominant wavelengths of a first system and a second system of the two electro-optic display systems, such that the output dominant wavelength of the first system and the output dominant wavelength of the second system approach to an intermediate value therebetween, and therefore the output dominant wavelength of the first system and the output dominant wavelength of the second system is consistent in the color space.

4. The gamma calibration method for three primary colors according to claim 3, wherein the method further comprising the following steps:

introducing and superposing other primary color components in the gamma calibration to correct an output of the first system and an output of the second system of the two electro-optic display systems with respect to an image video file, wherein said other primary color components are the primary colors other than the one that is being corrected.

* * * * *